US006722996B2

(12) United States Patent
Johnston

(10) Patent No.: US 6,722,996 B2
(45) **Date of Patent: *Apr. 20, 2004**

(54) MOVING UPLIFT APPARATUS

(76) Inventor: Gary Lawrence Johnston, P.O. Box 183, Cowarts, AL (US) 36321

( * ) Notice: Subject to any disclaimer, the term of this patent is extended or adjusted under 35 U.S.C. 154(b) by 0 days.

This patent is subject to a terminal disclaimer.

(21) Appl. No.: 10/277,493

(22) Filed: Oct. 21, 2002

(65) Prior Publication Data

US 2003/0036433 A1 Feb. 20, 2003

Related U.S. Application Data

(63) Continuation-in-part of application No. 10/051,920, filed on Jan. 22, 2002, which is a continuation-in-part of application No. 09/617,334, filed on Jul. 20, 2000, now Pat. No. 6,383,083.

(51) Int. Cl.[7] ..... A61G 11/00

(52) U.S. Cl. ..... 472/106; 472/108; 482/97; 482/106

(58) Field of Search ..... 472/106, 108, 472/112, 120; 482/72, 95, 96, 97, 106

(56) References Cited

U.S. PATENT DOCUMENTS 3,075,764 A * 1/1963 De Lorean ..... 482/31
3,311,373 A * 3/1967 Phillips ..... 472/108
4,032,138 A * 6/1977 Willis ..... 472/16
5,547,443 A * 8/1996 Chen ..... 482/72
6,383,083 B1 * 5/2002 Johnston ..... 472/106

* cited by examiner

*Primary Examiner*—Kien T. Nguyen

(57) ABSTRACT

A moving uplift apparatus is provided which enables the user to utilize the device as a piece of playground or backyard play equipment commonly known as a see-saw. The apparatus includes a frame structure, a user support mechanism, and a user engagement mechanism. The user support mechanism pivotally mounts to the frame structure, while the user engagement mechanism pivotally mounts to the user support mechanism. The user engagement mechanism may have engagement members for engaging said frame structure. The apparatus is different from the more conventional see-saw apparatuses in that the upward and downward pivoting motion of the user is produced by rocking the user engagement mechanism forward and backward, not by pushing against the ground with the feet of the user. The apparatus may be configured so that rocking the user engagement mechanism backward and forward may produces different seat movement, including rotation about the base of the frame structure. The apparatus may also take the form of a single user see-saw and/or exercise machine, with an optional weight support member for weighing down one side.

30 Claims, 24 Drawing Sheets

MOVING UPLIFT APPARATUS

CROSS-REFERENCE TO RELATED APPLICATIONS

This application is a Continuation-In-Part of U.S. patent application Ser. No. 10/051,920, filed Jan. 22, 2002, which itself is a Continuation-In-Part of U.S. patent application Ser. No. 09/617,334, filed Jul. 17, 2000, now U.S. Pat. No. 6,383,083, which issued May 17, 2002.

BACKGROUND OF THE INVENTION

This invention relates to a moving uplift apparatus which has an upright structure that allows the user to uplift themselves while in a seated position. The pivoting motion of the user allows the device to be used as a piece of playground or backyard equipment, commonly known as a see-saw, or as a piece of exercise equipment.

SUMMARY AND OBJECTS OF THE INVENTION

It is the object of this invention to provide a moving uplift apparatus which may be used by a user to uplift themselves while in a seated position. The main purpose of this application is to demonstrate an apparatus which may perform the stated function, and to demonstrate the many options and configurations this apparatus may take on.

Briefly stated, the apparatus that forms the basis of the present invention comprises a frame structure means, a user support means, and a user engagement means. The user support means pivotally mounts on the frame structure means, while the user engagement means pivotally mounts upon the user support means. Optional items will include a weight support, which may be used when the device is configured as a single user see-saw or as an exercise product.

The design of the apparatus is such that the user support means pivots upward and downward upon the frame structure means, and the user engagement means pivots backward and forward upon the user support means. The user sits in a seat member and pivots the user engagement means. The user engagement means is operatively connected to the frame structure means in such a manner that pivoting the user engagement means in one direction causes the seat member to pivot upward, while piovoting the user engagement means in the opposite direction causes the seat member to pivot downward. The device may have two seat members which allows two people to use the device at the same time. The user engagement means may be designed in such a manner that the two users experience the same type of motion simultaneously, but in a opposite direction. Other objects, features, and advantages for this invention will be apparent from the following detailed description and the appended claims, references being made to the accompanying drawings forming a part of the specification, wherein like reference numerals designate corresponding parts of the several views.

BRIEF DESCRIPTIONS OF THE DRAWINGS

Figure 5A:
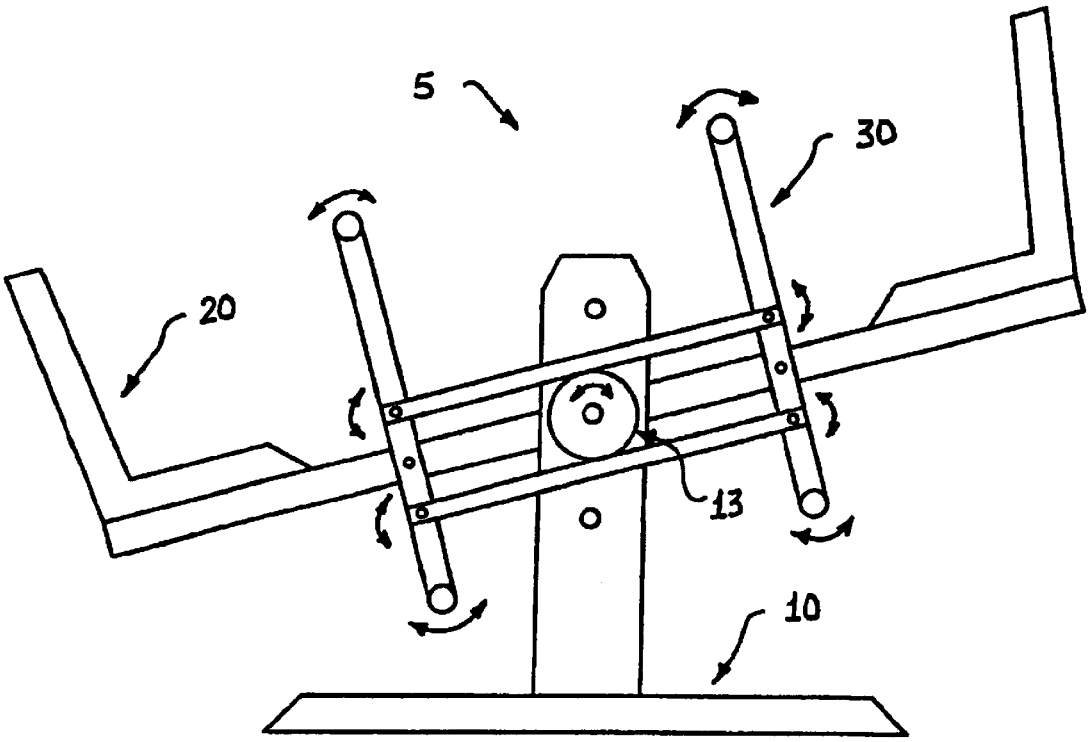
Figure 5B:
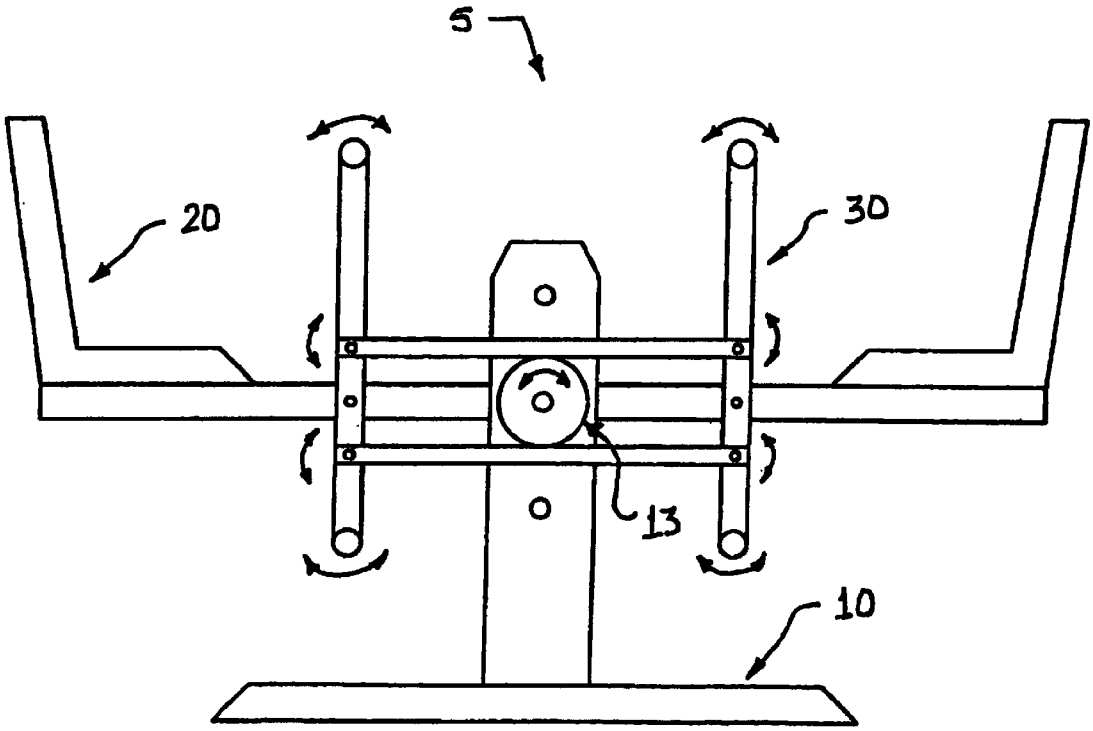
Figure 5C:
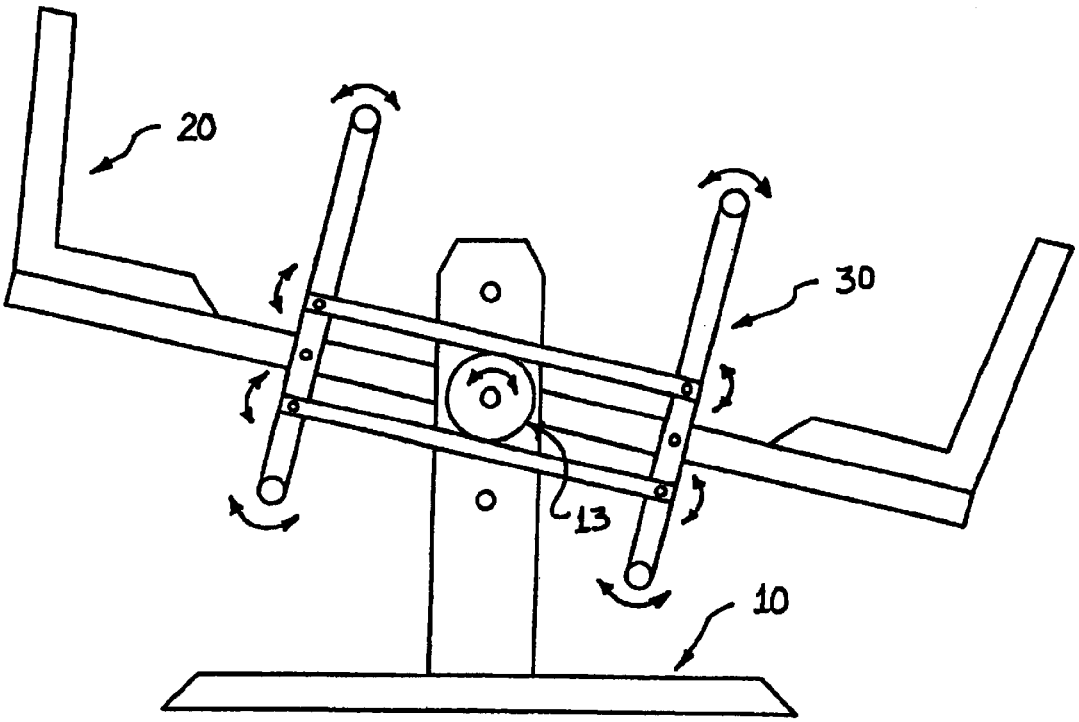

FIGS. 5A, 5B, and 5C are front views of one embodiment of the moving uplift apparatus.

Figure 6A:
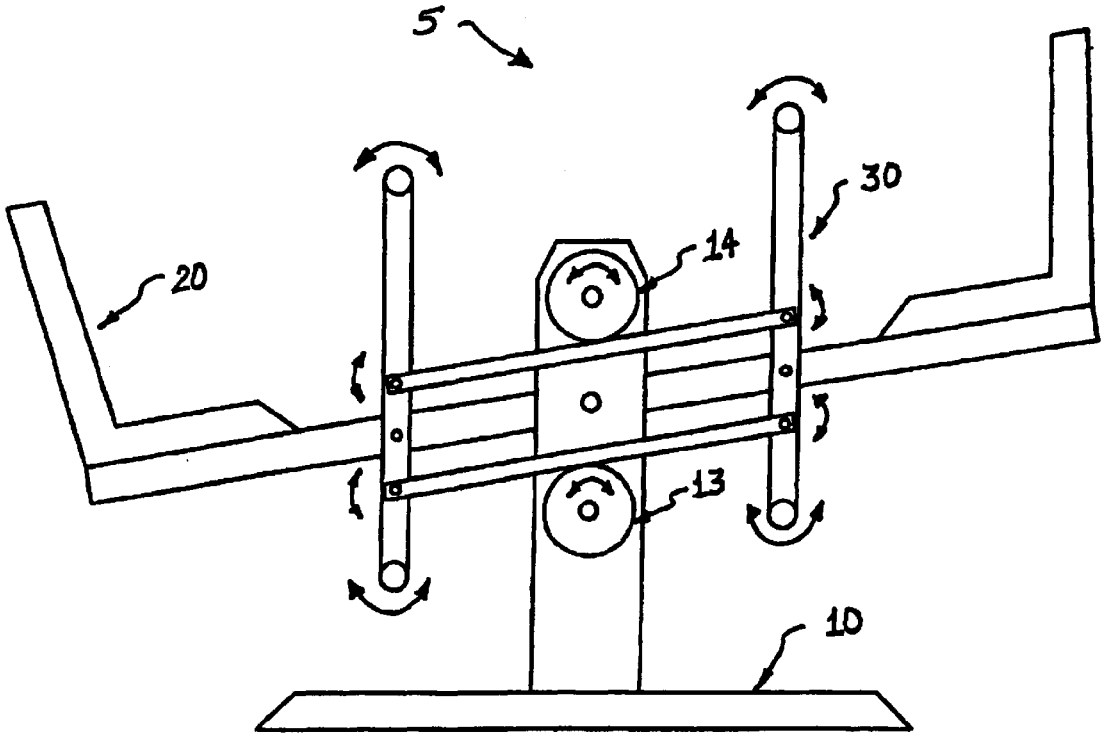
Figure 6B:
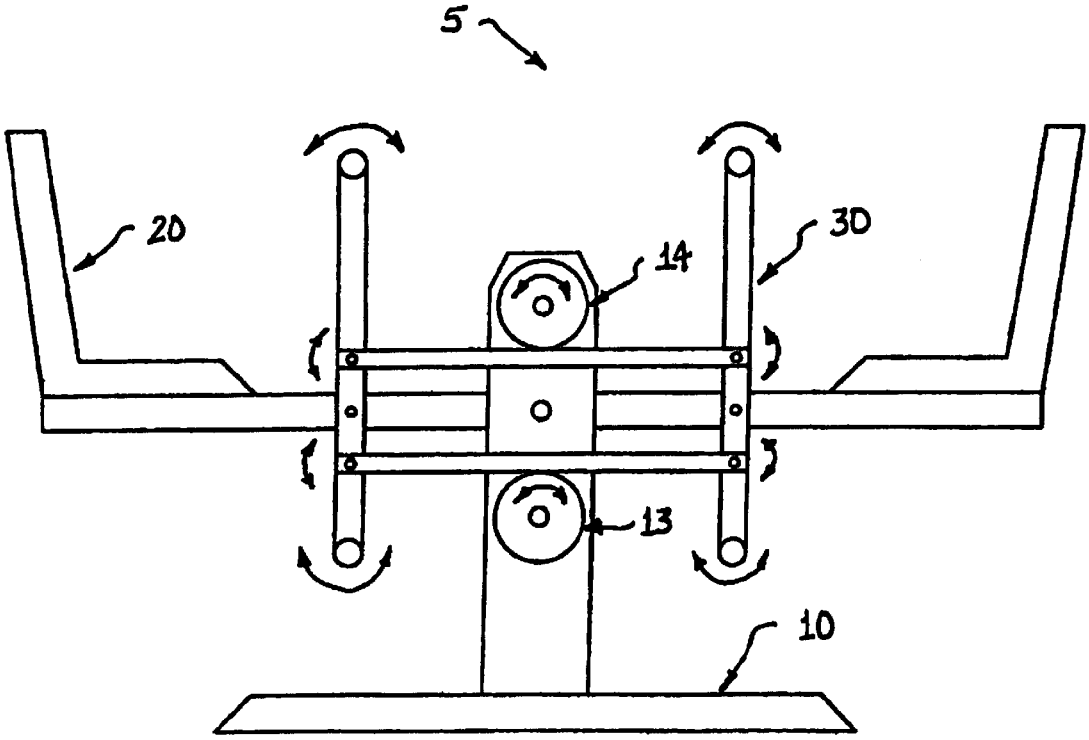
Figure 6C:
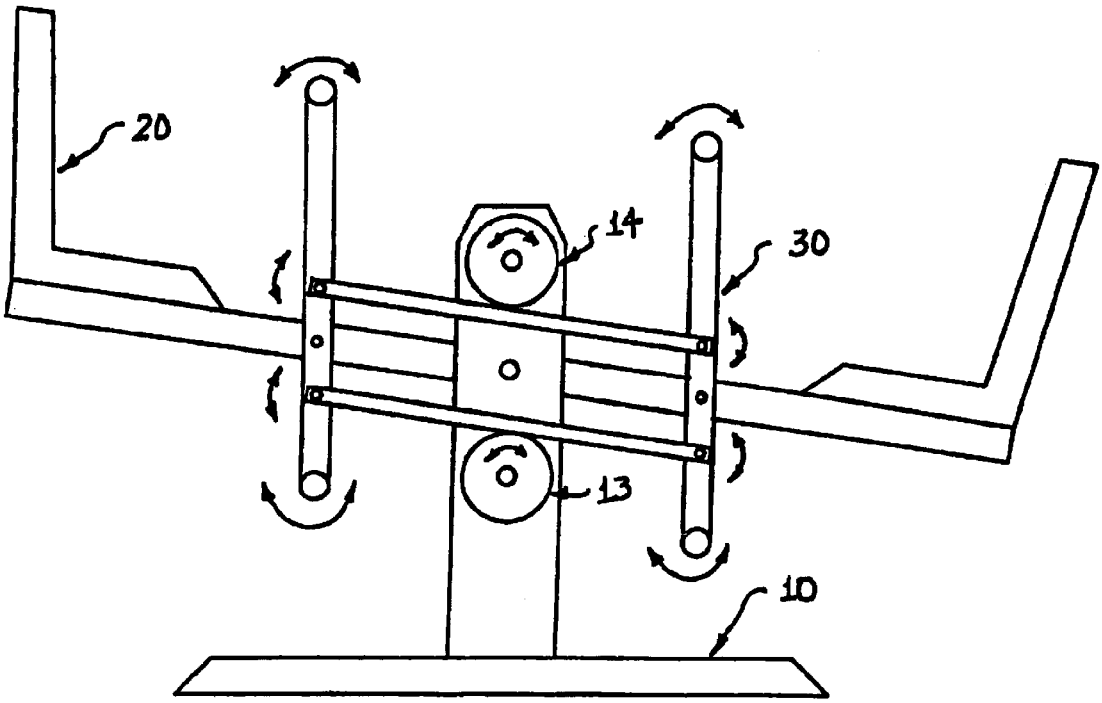

FIGS. 6A, 6B, and 6C are front views of a second embodiment of the moving uplift apparatus.

Figure 6D:
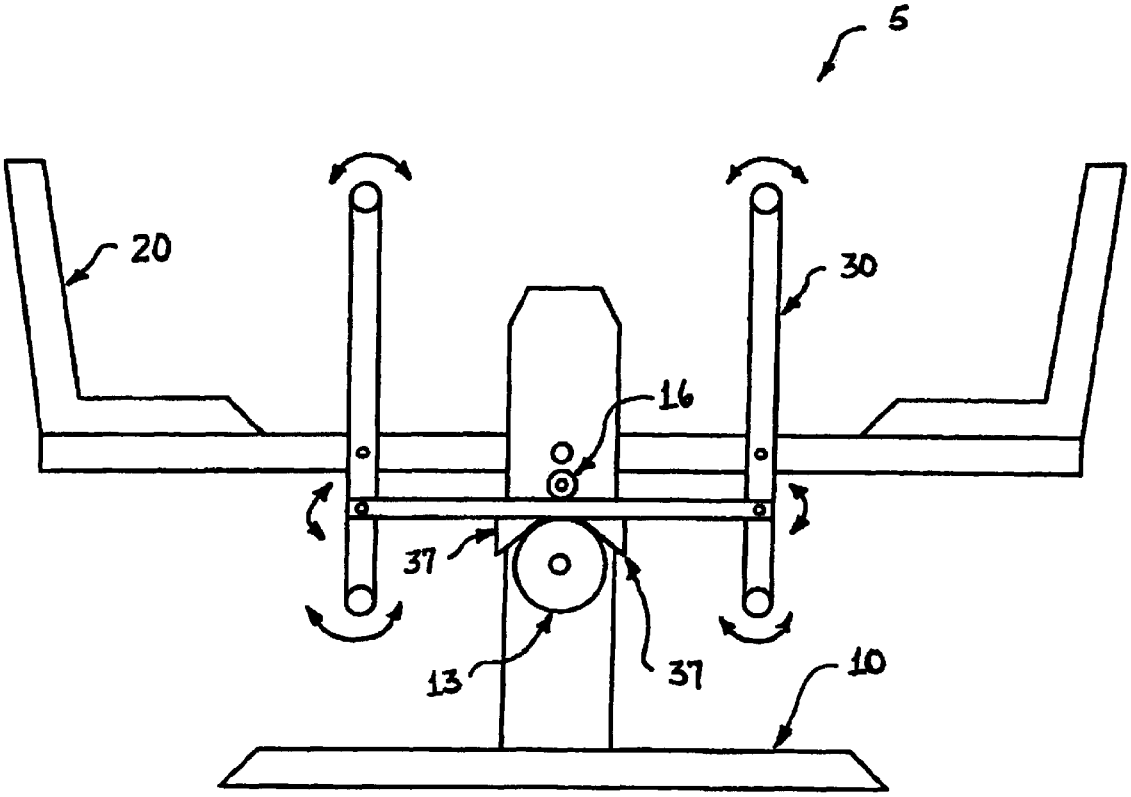
Figure 6E:
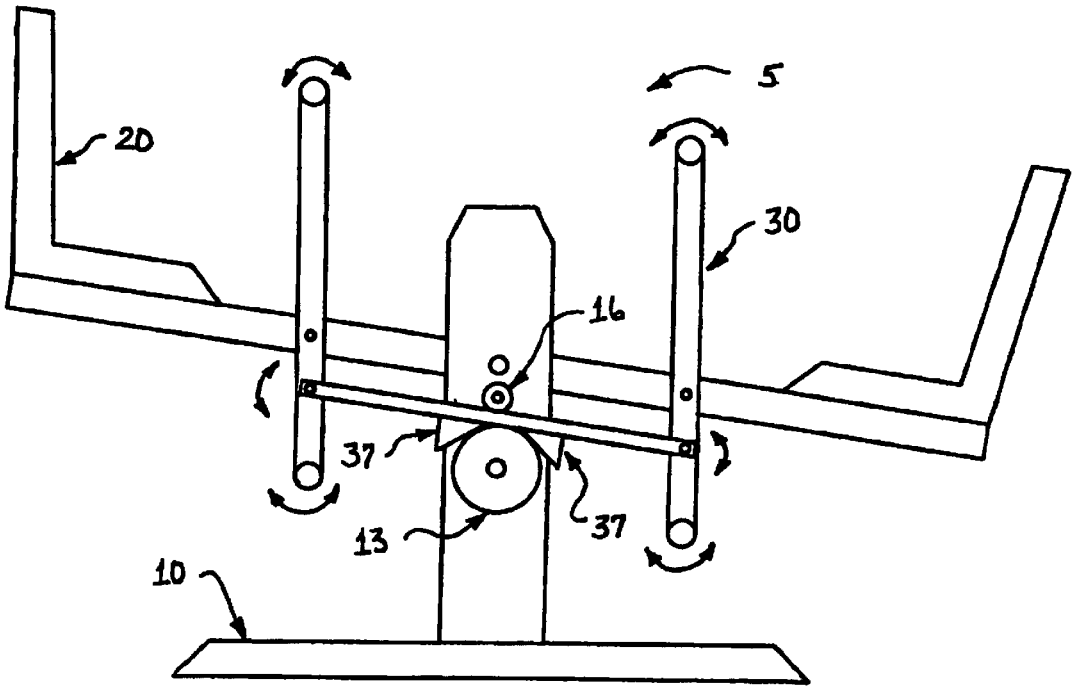

FIGS. 6D and 6E are front views of the moving uplift apparatus, demonstrating a one type of engagement member which may be part of the user engagement means.

Figure 6F:
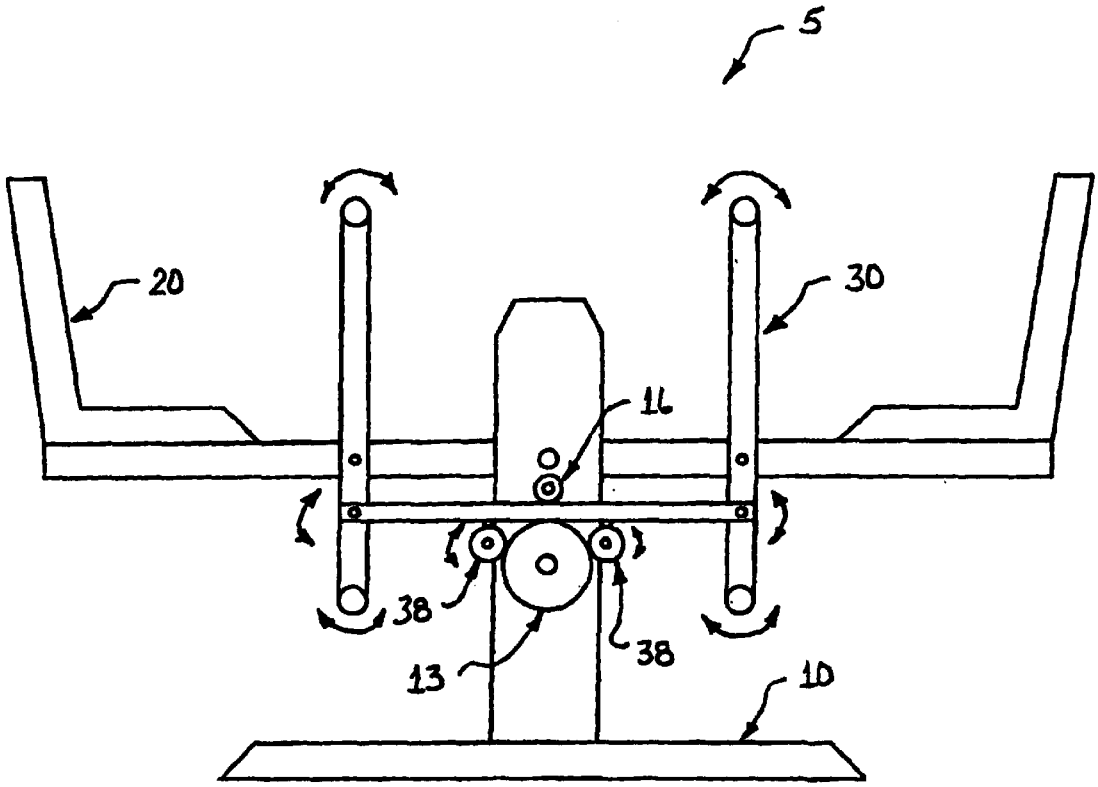
Figure 6G:
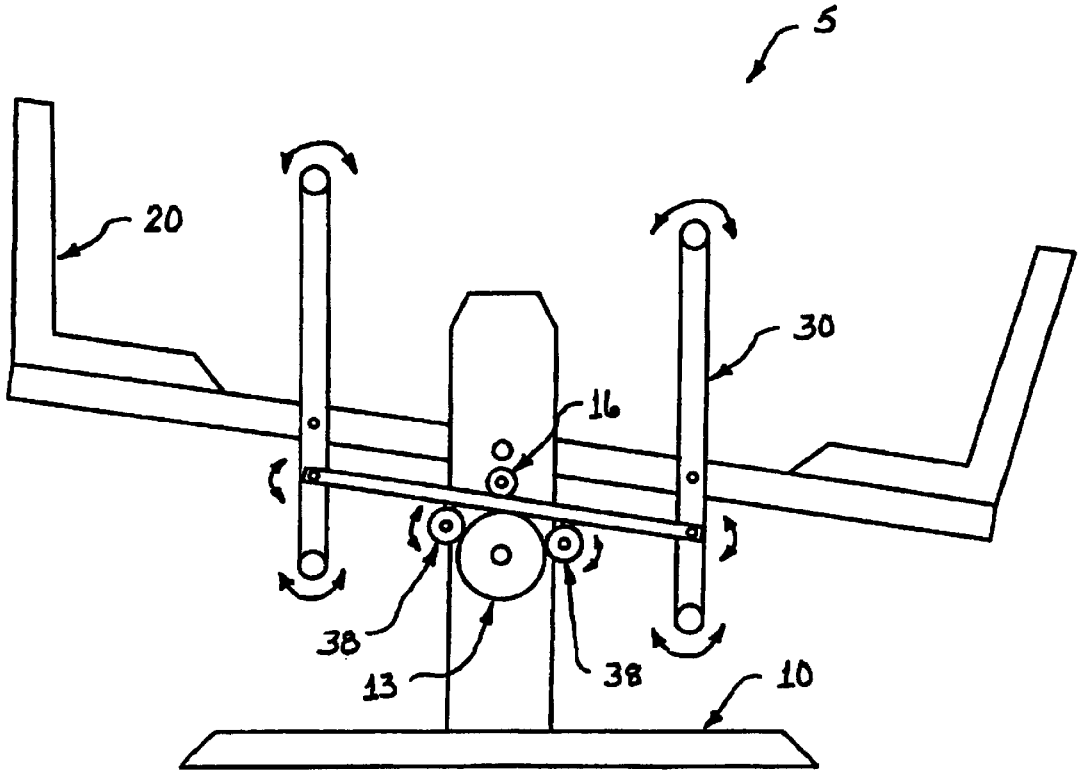

FIGS. 6F and 6G are front views of the moving uplift apparatus, demonstrating a second type of engagement member which may be part of the user engagement means.

Figure 7:
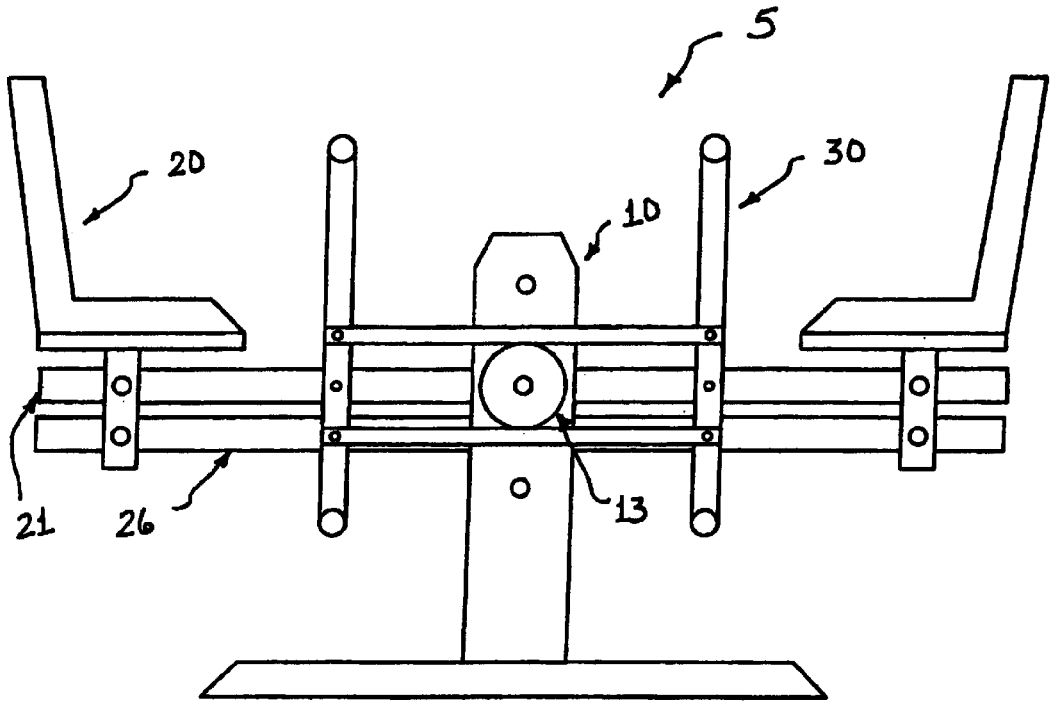

FIG. 7 is a front view of the moving uplift apparatus with the user support means utilizing a double lever assembly.

Figure 8:
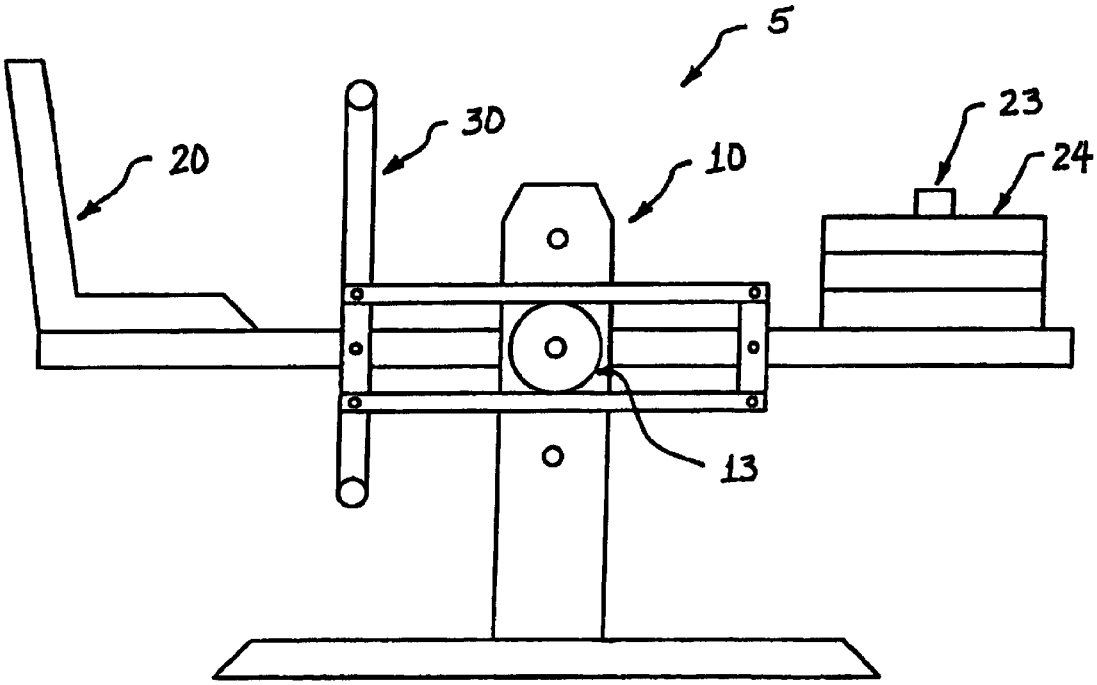

FIG. 8 is a front view of the moving uplift apparatus when configured for a single user and also for an exercise machine.

Figure 9A:
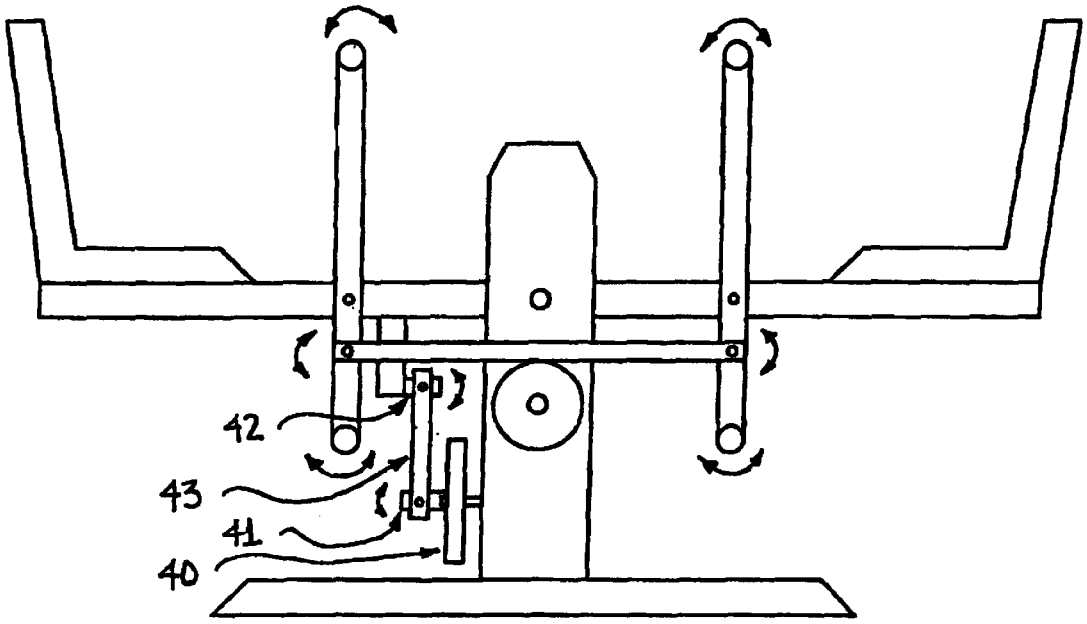

FIG. 9A is a front view of the apparatus with an optional rotating wheel assembly for making motion of the apparatus smoother.

Figure 9B:
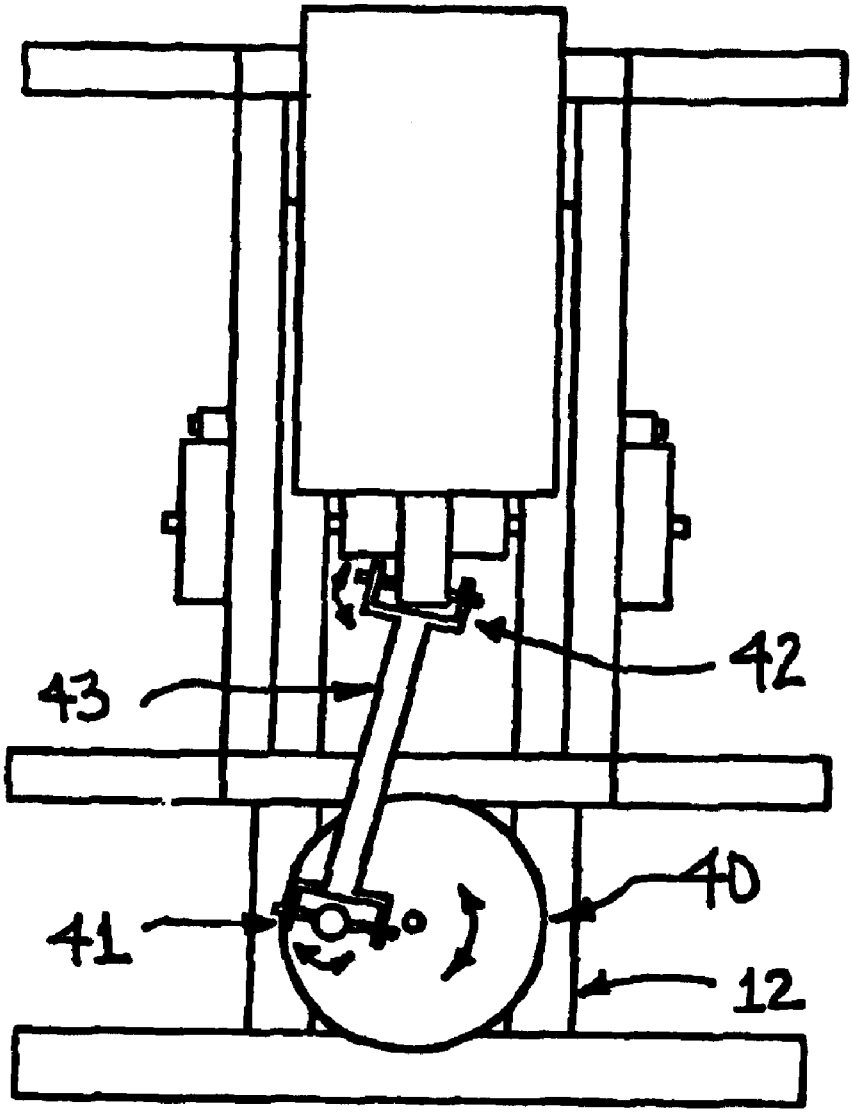

FIG. 9B is a side view of the apparatus with an optional rotating wheel assembly for making motion of the apparatus smoother.

Figure 10A:
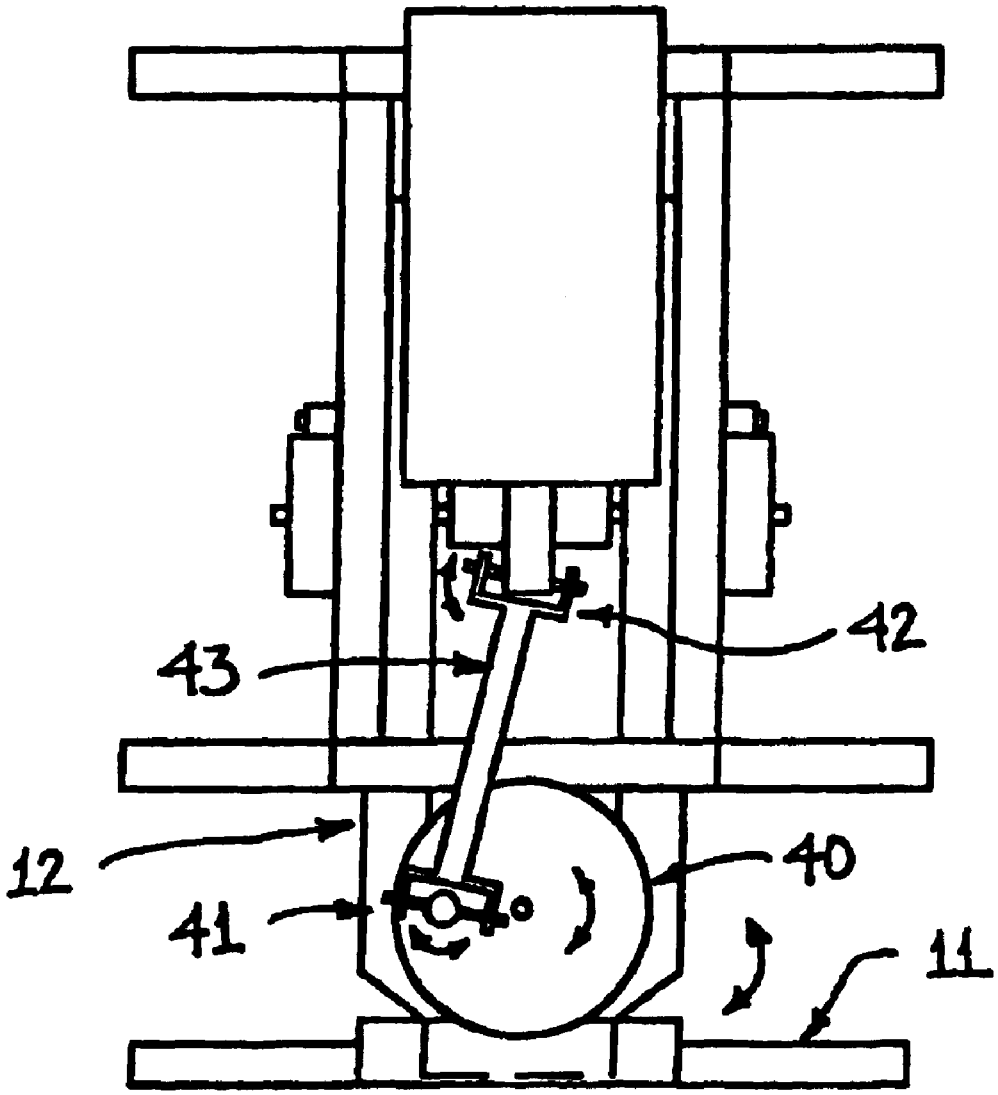

FIG. 10A is a front view of the apparatus demonstrating the frame structure means with the capability of rotating the user in a circular pattern.

Figure 10B:
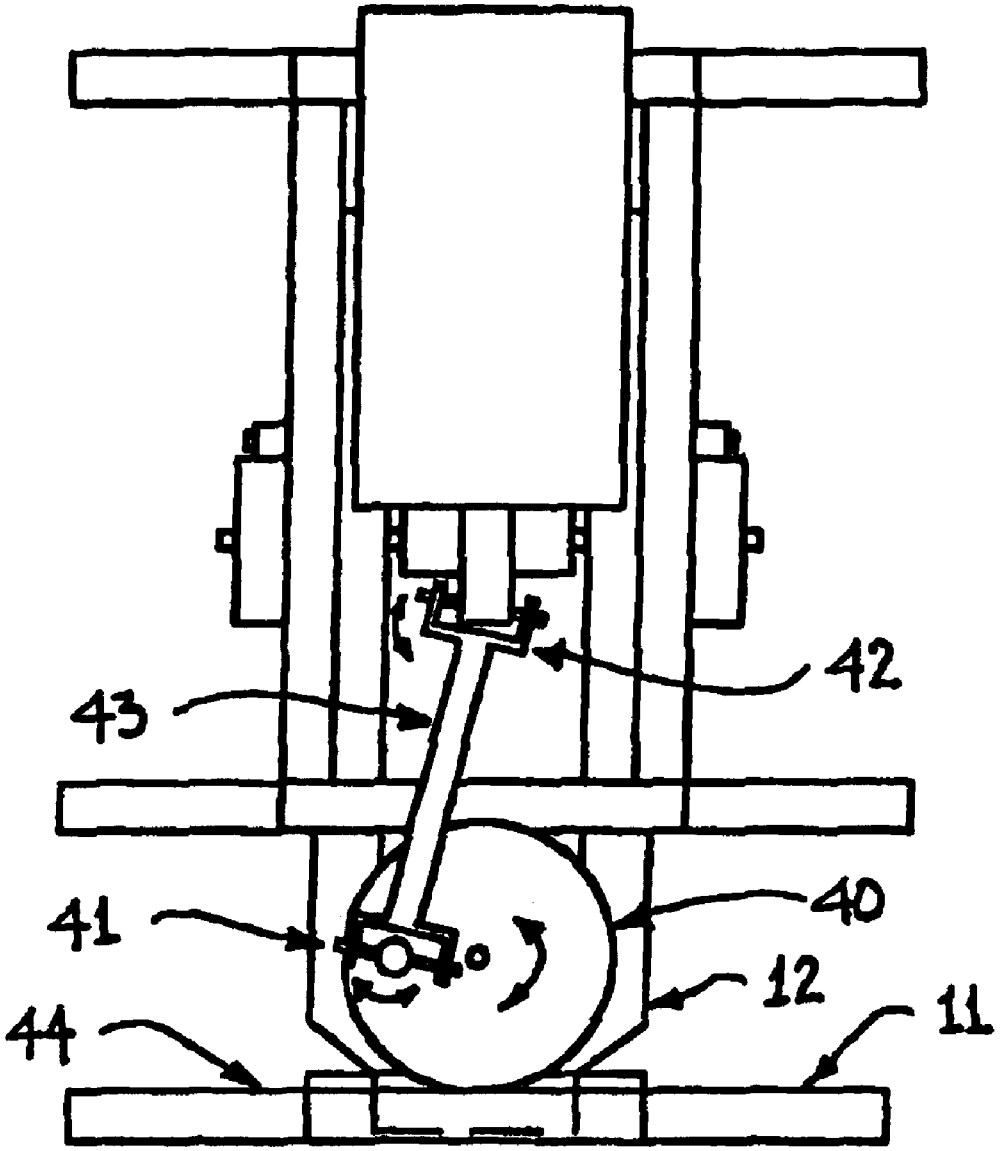

FIG. 10B is a front view of the apparatus with an optional platform member which may be utilized by the rotating wheel assembly for rotating the user support means in a circular pattern.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since it is capable of other embodiments and of being practiced or carried out in various ways. Also, it is to be understood that the phraseology and terminology employed herein is for the purpose of description, and not limitation.

Figure 1A:
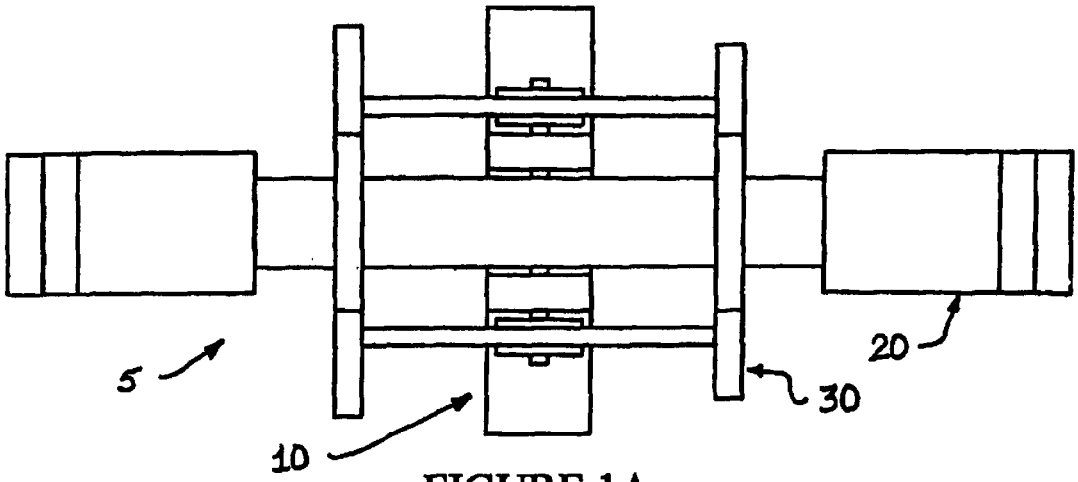
FIG. 1A is a top view of the moving uplift apparatus.
Figure 1B:
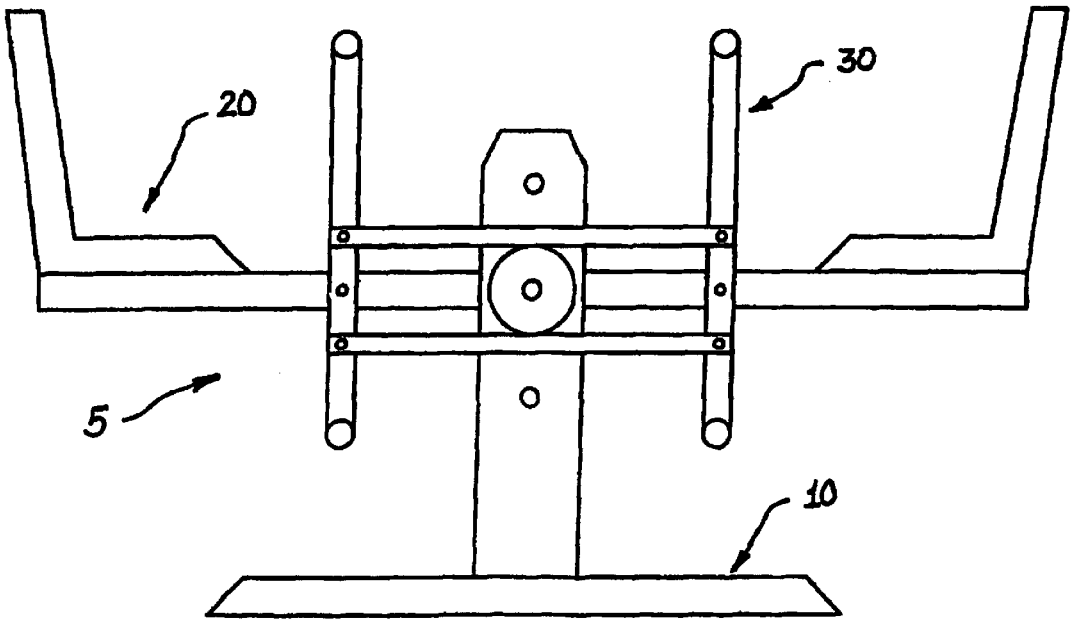
FIG. 1B is a front view of the moving uplift apparatus.
Figure 1C:
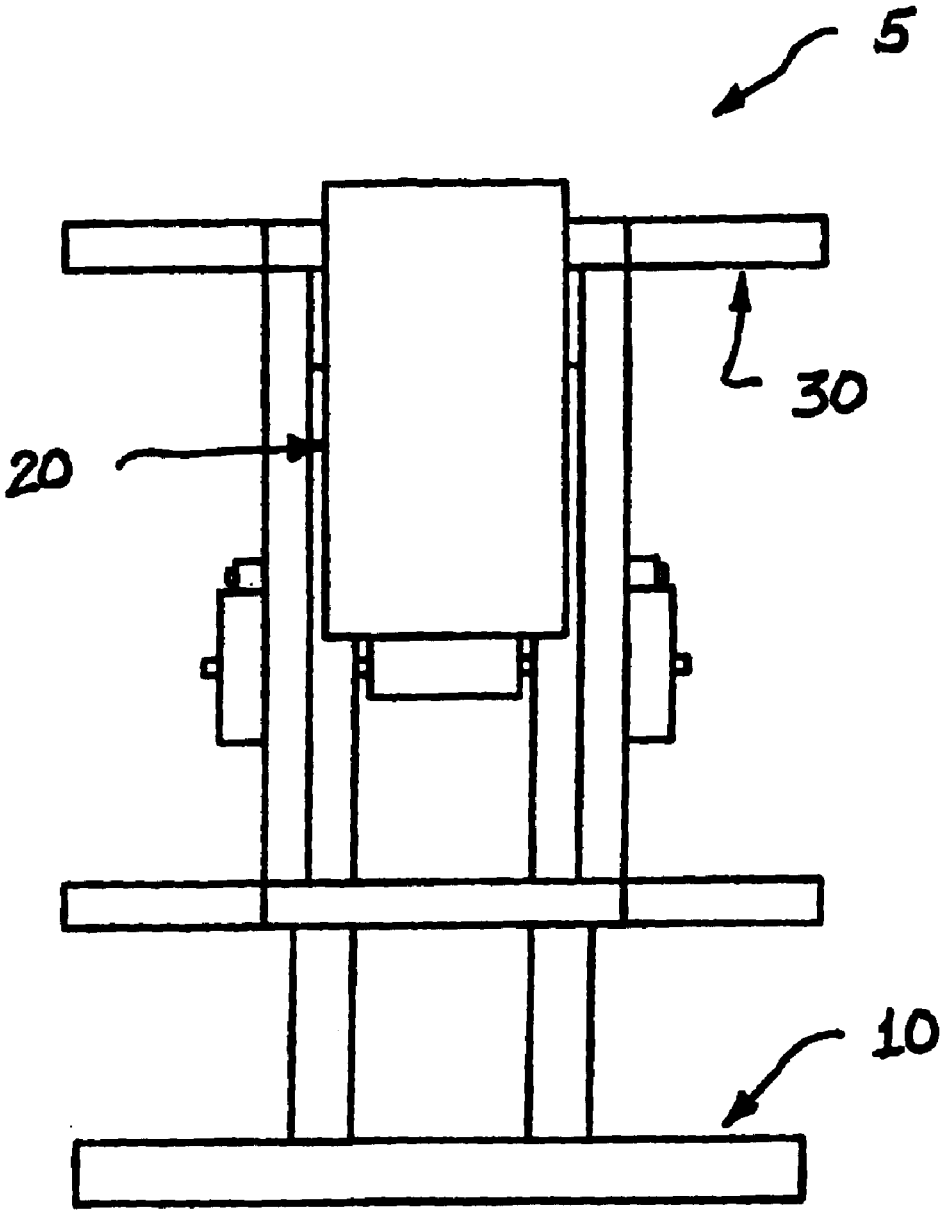
FIG. 1C is a side view of the moving uplift apparatus.

As best can be seen by references to the drawings, and in particular to FIGS. 1A–1C, the moving uplift apparartus that forms the basis of the present invention is designated generally by the reference numeral 5, and includes a frame structure means 10, a user support means 20, and a user engagement means 30. The user support means 20 pivotally mounts upon frame structure means 10, while the user engagement means 30 pivotally mounts upon user support means 20.

Figure 2A:
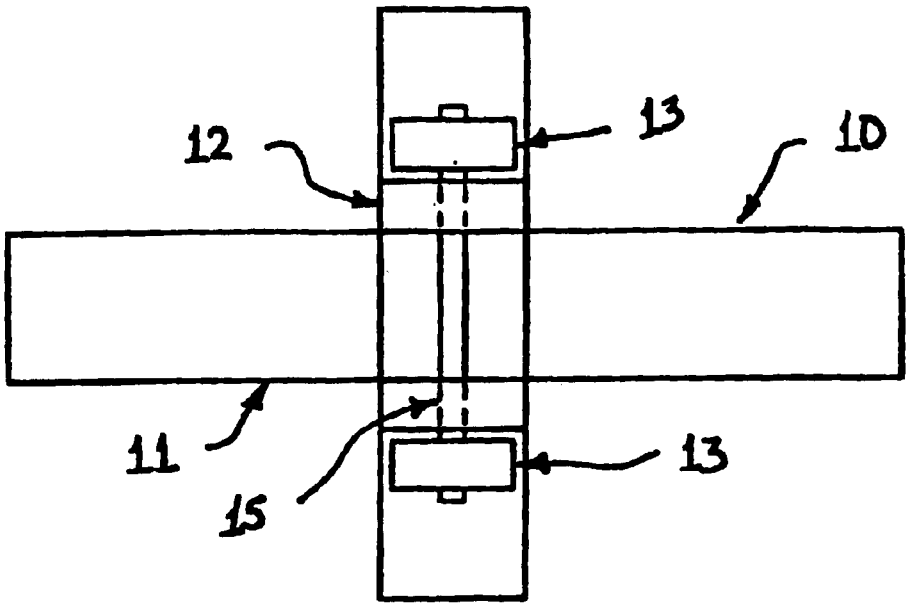
FIG. 2A is a top view of the frame structure means of the moving uplift apparatus.
Figure 2B:
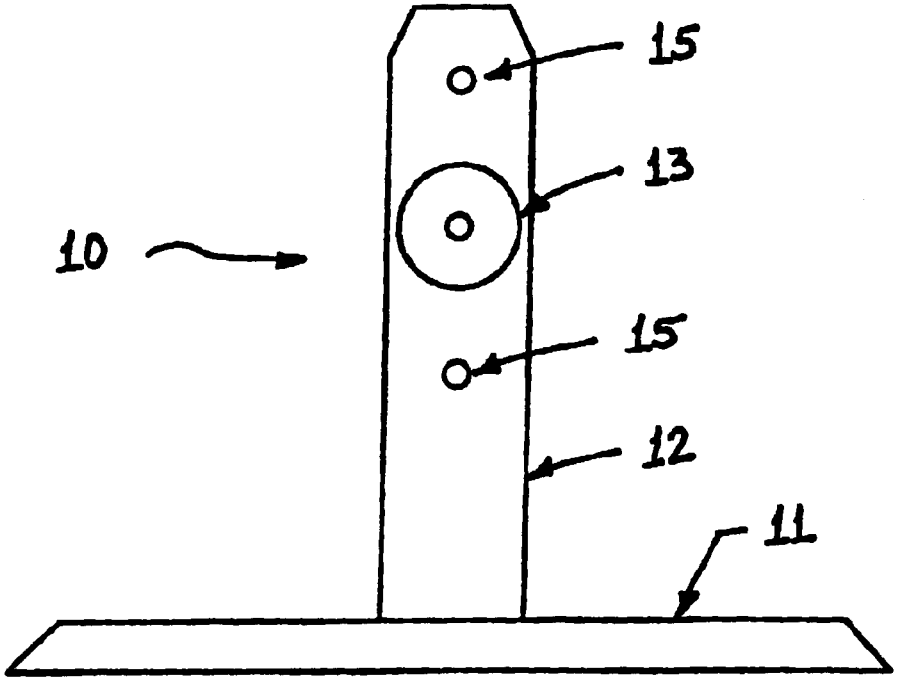
FIG. 2B is a front view of the frame structure means of the moving uplift apparatus.
Figure 2C:
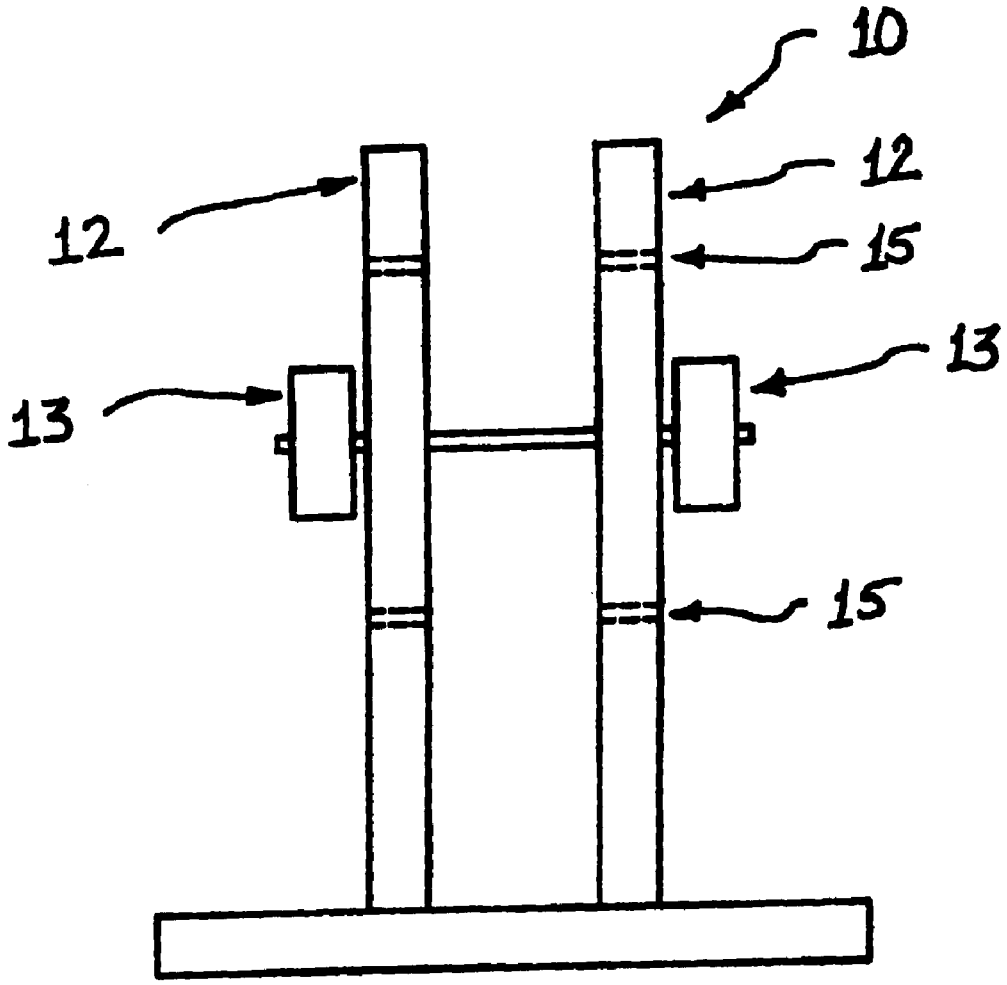
FIG. 2C is a side view of the frame structure means of the moving uplift apparatus.

As may be seen in FIGS. 2A–2C, the frame structure means 10 comprises a base member 11, at least one support member 12, at least one curved member 13, and frame openings 15. The support member 12 is an upwardly extending structure, rigidly supported at its lower end by base member 11. Main curved member 13 may rotatably mount to support member 11 through one of the frame openings 15 via a bolt, pin, or the like. It could also be rigidly mounted, but the rotatably mounting is preferred.

Figure 3A:
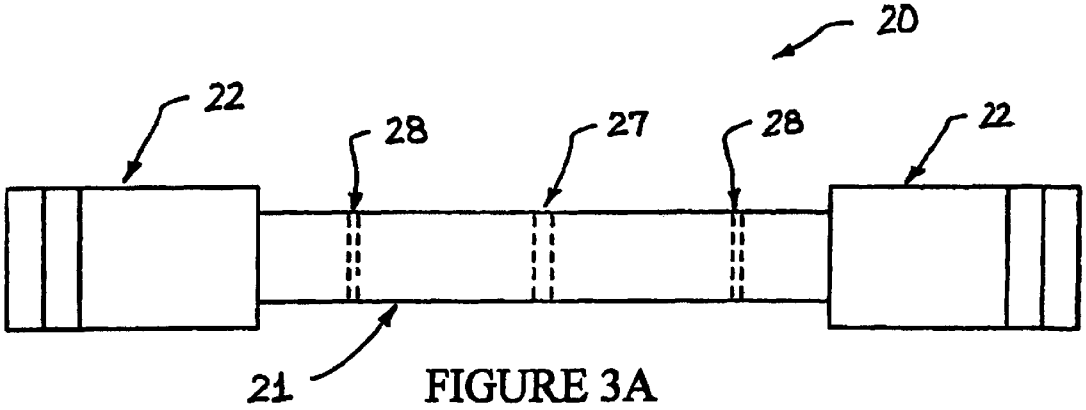
FIG. 3A is a top view of the user support means of the moving uplift apparatus.
Figure 3B:
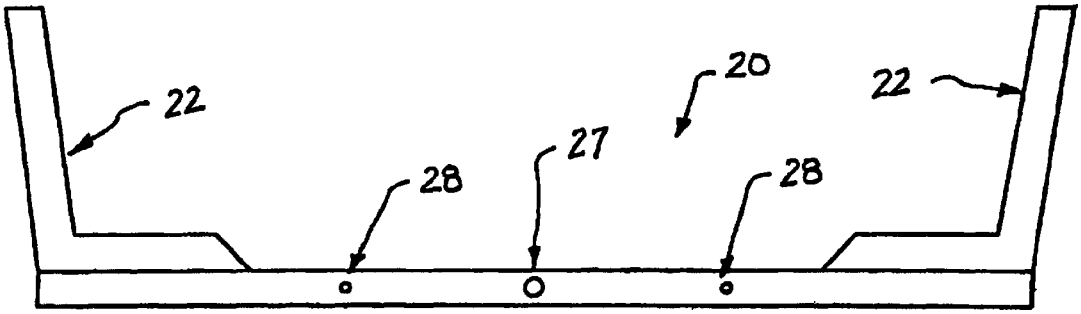
FIG. 3B is a front view of the user support means of the moving uplift apparatus.
Figure 3C:
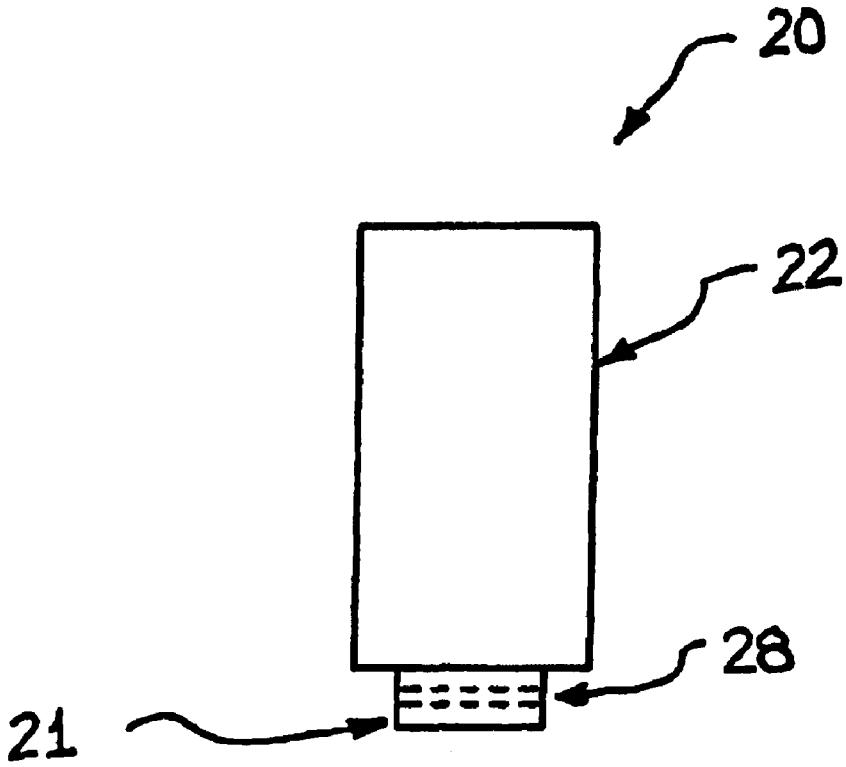
FIG. 3C is a side view of the user support means of the moving uplift apparatus.

As may be seen in FIGS. 3A–3C, the user support means 20 comprises at least one main lever member 21, seat members 22, support openings 27, and engagement openings 28. Main lever member 21 is a generally horizontal structure having a seat member 22 rigidly mounted at opposite ends. The main lever member 21 pivotally mounts to the support member 12 of frame structure means 10 through support openings 27 of main lever member 21, and frame opening 15 of support member 12. As seen, in the one embodiment, the bolt or pin used to mount main curved member 13 to support member 12 is also used to pivotally mount main lever member 21 to support member 12. In a second embodiment, which will be described later, there will be seperate bolts or pins for mounting main curved member 13 and main lever member 21.

Figure 4A:
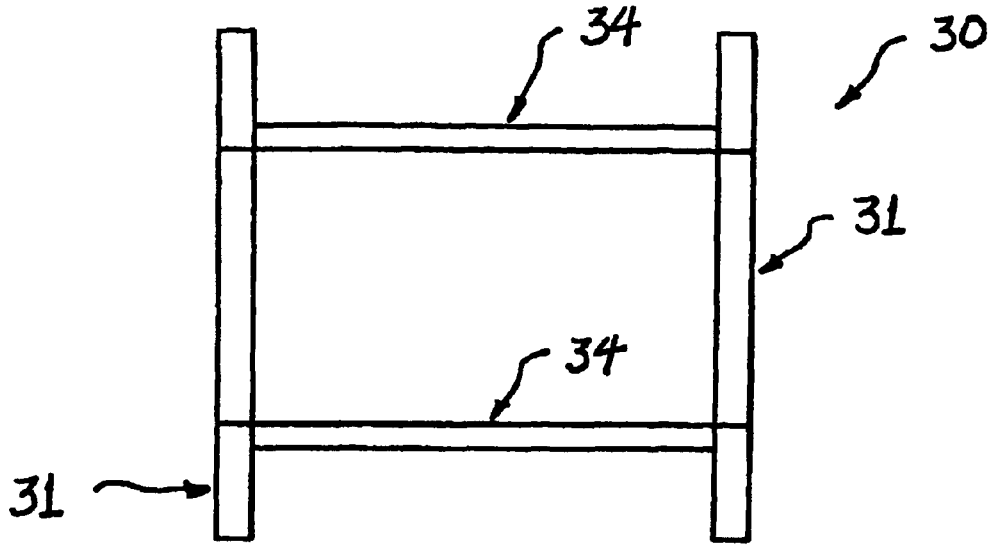
FIG. 4A is a top view of the user engagement means of the moving uplift apparatus.
Figure 4B:
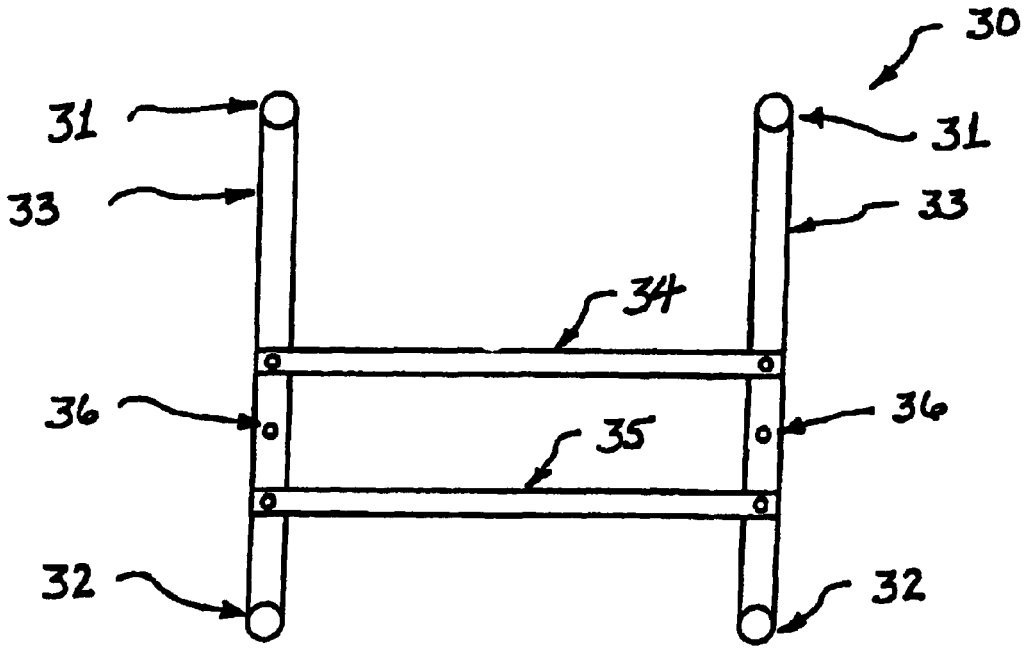
FIG. 4B is a front view of the user engagement means of the moving uplift apparatus.
Figure 4C:
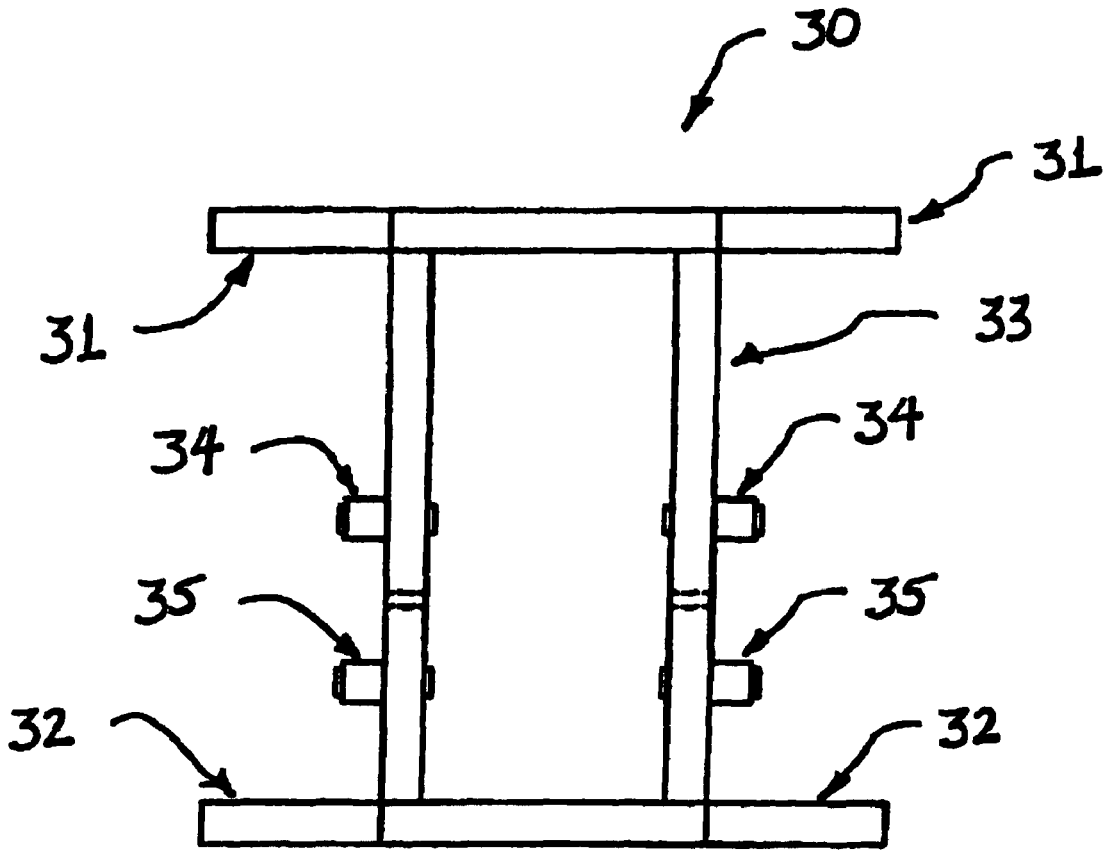
FIG. 4C is a side view of the user engagement means of the moving uplift apparatus.

As may be seen in FIGS. 4A–4C, user engagement means 30 comprises at least two rocker members 31 pivotally mounted to main lever member 21 through engagement openings 28. Each rocker member 31 is a generally upwardly extending structure and may have an upper engagement member 32 mounted at or near the top, and a lower engagement member 33 mounted at or near the bottom. Either the upper engagement member 32 or the lower engagement member 33 may be considered optional, since only one is needed for user engagement. The rocker members 31 mounted on oppsoite ends of main lever member 21. The upper ends of each rocker member 31 are pivotally connected together using upper connection members 34, while the lower ends of rocker members 31 are pivotally connected together using lower connection members 35. Again, either upper connection member 34 or lower connection member 35 may be considered optional, since only one is needed for operation. The connection member, along with main lever member 21, keep the rocker members 31 parallel to one another while the apparatus is in operation.

FIGS. 5A–5C demonstrate one embodiment of the apparatus while in operation. As may be seen in these figures, moving the upper engagement member 32 in the forward direction and/or the lower engagement member 33 in the backward direction will cause the corresponding seat member 22, and thus the user, to pivot in the upward direction. Conversely, moving the upper engagement member 32 in the backward direction and/or the lower engagement member 33 in the forward direction will cause the corresponding seat member 22, and thus the user, to pivot downward. Motion in the upper engagement member 32 will normally be produced by the upper body of the user, i.e. the arms and hands, while the motion in the lower engagement member 33 will normally be produced buy the lower body of the user, i.e. the legs and feet. The apparatus may also be designed to utilize other parts of the body for engagement.

The pivoting motion is produced when the upper connection member 34 engages main curved member 13. As upper engagement member 34 is moved in one direction, the force exerted upward by curved member 13 on upper connection member 34 will cause the end of main lever member 21, towards which the connection member moves, to pivot downward. In this configuration, lower connection member 35 is not necessarily required, but does assist somewhat in producing the motion, and also keeping rocker members 31 generally parallel to one another. The opposite may also be considered true. Lower connection member 35 may be used to cause the pivoting movement of main lever member 21, while upper connection member 34 may be considered optional. In this embodiment, rocker members 31 will remain generally perpendicular to main lever member 21. Even though some of the figures may demonstrate multiple connection members and multiple curved members, only one connection member and only one curved member is actually required for the apparatus to operate.

FIGS. 6A–6C demonstrate a second embodiment of the turning uplift apparatus. In this instance, curved member 13 has been moved to a lower position, so that lower connection member 35 engages the upper part of curved member 13. This, in effect, causes an opposite motion from that previously shown and described. Moving the upper engagement 32 in the backward direction and/or the lower engagement member 33 in the forward direction, causes the corresponding seat member 21 to pivot upward. Conversely, moving the the upper engagement member 32 in the forward direction and/or lower engagement member 33 in the backward direction causes the corresponding seat member 21, and thus the user, to move downward.

The pivoting motion is produced when the lower connection member 35 engages main curved member 13. As lower connection member 35 is moved in one direction, the force exerted upward by main curved member 13 on lower connection member 35 will cause the end of main lever member 21, towards which the connection member moves, to pivot downward. This motion is thus opposite from the other embodiment. In this instance, upper connection member 32 is optional. A secondary curved member 14 may be added to engage upper connection member 32, with upper connection member 32 engaging the bottom part of secondary curved member 14.

As with the previous embodiment, the opposite may hold true. Secondary curved member 14 may become the main curved member, with upper connection member 34 causing the pivoting movement of main lever member 21, with the lower connection member 35 and curved member 13 being considered as the optional items. Again, even though some of the figures may demonstrate multiple connection members and curved members, only one connection member and one curved member is actually required for the apparatus to operate.

FIGS. 6D–6G demonstrate engagement members 37 and 38, which may be part of or added to the connection member 35. These engagement members are mainly used for assisting connection member 35 in its movement along main curve member 13. Also shown is an additional curved member 16, which is used to keep connection member 35 in close proximity to main curved member 13. In most instances, it will keep either the connection member 35 or the engagement members 37 and 38 in contact with main curved member 32. FIGS. 6D and 6E demonstrate one type of engagement members 37, which are triangular-shaped objects rigidly attached to connection member 35 such that are on opposite sides of main curved member 13. When the side of each respective engagement member 37 is pushed against main curved member 13, it will produce upward movement in that part of connection member 35. FIGS. 6F and 6G demonstrate a second type of engagement members 38, which are also curved members, mounted on opposite sides of main curved member 13. These curved members may be rigidly or rotatably mounted to connection member 35. Similarly, when one of engagement members 38 is pushed against main curved member 13, it will produce upward movement in that part of connection member 35. The engagment members 37 and 38 may be mounted in various ways to either or both connection members 34 and 35, and engage respective curved members 13 and 14 when both are utilized, to produce the previously described movements in the apparatus. The configuration described above is intended as demonstration, since many variations are possible.

As may be seen in FIG. 7, a secondary lever member 26 may be used in conjunction with main lever member 21 of user support means 20. This secondary lever member 26 is also pivotally mounted to support member 12 of frame structure means 10. The seat member 22 may be pivotally mounted to both main lever member 21 and secondary lever member 26, so that the seat maintain a generally horizontal position during operation of the apparatus. This well-known double lever feature may be incorporated into either embodiment of the apparatus.

FIG. 8 demonstrates the apparatus while being used as a single user see-saw device, and/or as an exercise machine. As seen, there is only one seat member 22, one upper engagement member 32, and one lower engagement 33. However, a second rocker member 31 is needed. An optional item is a weight support member 23, which may be used to support weight members 24. Weights may be used not only when the apparatus is configured as an exercise machine, but also when it is configured as a single user see-saw, to make operation easier. Again, these features may be incorporated into either embodiment of the apparatus.

As may be seen in FIGS. 9A and 9B, a rotatable member 40 may be mounted at its proximate center on the support member 12 of frame structure means 10. A first rotatable pin 41 may be mounted at some point along rotatable member 40, while a second rotatable pin 42 may be mounted on lever member 21 of user support means 20. A linkage member 43 may then be pivotally mounted on one end to rotatable pin 41, and pivotally mounted on its other end to rotatable pin 42. The linkage member 43 thus connects lever member 21 and rotatable member 40 through universal-type joint connections. These type of connections will compensate for the different relative positions of the lever member 21 and rotatable member 40. Preferrably, rotatable member 40 is a flywheel, with it being utilized to make motion of the apparatus smoother.

FIG. 10 demonstrates a modification to the base member 11 and support member 12 of the frame structure means 10. In this instance, support member 12 may be constructed so that its bottom rotates within base member 11, thus allowing support member 12 to rotate around base member 11. With rotatable member 40 being a flywheel, the momentum of the flywheel will cause support member 12 to rotate around base 11 as lever member 21 moves upward and downward.

As may be seen further in FIG. 11, a platform member 44 may also be part of the base, with rotatable member 40 being in rolling contact with platform member 44. Thus as rotatable member 40 rotates while in contact with platform member 44, the support member 12 will again rotate about base member 11, but at a much faster rate. In this instance, rotatable member 40 does not have to necessarily need to be a flywheel, but again, a flywheel will make motion of the apparatus smoother.

Many variations of the moving uplift apparatus exist, along with the configurations described above. While it will be apparent that the embodiments of the invention herein is well calculated to fulfill the objects stated above, it will be appreciated that the invention is susceptible to modification, variation, and change without departing from the proper scope or fair meaning of the subjoined claims.

I claim:

1. A moving uplift apparatus comprising:

a frame structure means having a curved member mounted thereon;

a user support means pivotally mounted to said frame structure means;

a user engagement means pivotally mounted to said user support means; said user engagement means having a connection member operatively engaging said curved member of said frame structure means, said connection member operatively engaging said curved member by moving along at least a portion of its curved surface; whereby pivoting said user engagement means in the forward and backward directions produces upward and downward pivoting motion in said user support means.

2. The moving uplift apparatus as claimed in claim 1, said frame structure means further comprising:

a base;

at least one support member extending generally upward from said base, said curved member being rotatably mounted to said support member.

3. The moving uplift apparatus as claimed in claim 2, said curved member being a wheel.

4. The moving uplift apparatus as claimed in claim 2, said user support means further comprising:

at least one generally horizontal lever member, said lever member being pivotally mounted to said support member of said frame structure means;

at least one seat member mounted on one end of said lever member.

5. The moving uplift apparatus as claimed in claim 4, said user engagement means comprising:

at least two rocker members pivotally mounted to said lever member of said user support means, said rocker members being pivotally mounted on opposite ends of said lever members;

at least one upper engagement member mounted near the top of one of said rocker members;

said connection member pivotally connecting said rocker members so that said rocker members remain generally parallel to one another, said connection member operatively engaging said curved member of said frame structure means; whereby moving said connection member backward and forward against said curved member of said frame structure means produces upward and downward movement of said lever member of said user support means.

6. The moving uplift apparatus as claimed in claim 4, said user engagement means further comprising at least one lower engagement member mounted near the bottom of one of said rocker members.

7. The moving uplift apparatus as claimed in claim 4 further comprising a second generally horizontal lever member pivotally mounted on said support member of said frame structure means; said seat pivotally mounted to both lever members such that said lever member remain parallel to one another, and said seat maintains a generally horizontal position as said lever members pivot.

8. The moving apparatus as claimed in claim 4 further comprising a rotatable member operatively connected to said lever member, said rotatable member making motion of said apparatus smoother.

9. The moving uplift apparatus as claimed in claim 8, said rotatable member being a flywheel.

10. The moving uplift apparatus as claimed in claim 8, said support member being turnable mounted to said base, said rotatable member being used to produce turning motion in said support member about said base.

11. The moving uplift apparatus as claimed in claim 8, said support member being turnably mounted to said base, said rotatable member being in rolling contact with said base for producing turning motion in said support member around said base.

12. The moving uplift apparatus as claimed in claim 1 further comprising a weight support assembly mounted on one end of said lever member.

13. The moving uplift apparatus as claimed in claim 1, said frame structure means further comprising a support curved member for keeping said connection member of said user engagement means in close proximity to said curved member of said frame structure means.

14. The moving uplift apparatus as claimed in claim 1, said connection member of said user engagement means further comprising engagement members for engaging said curved member of said frame structure means.

15. The moving uplift apparatus as claimed in claim 14, said engagement members having a relatively flat side and rigidly mounted to said connection member such that said flat side engages said curved member at an angle.

16. The moving uplift apparatus as claimed in claim 14, said engagement members being wheels rotatably mounted to said connection member.

17. A moving uplift apparatus comprising:

a frame structure means having a first engagement member and a second engagement member mounted thereon;

a user support means pivotally mounted to said frame structure means;

a user engagement means pivotally mounted to said user support means; said user engagement means having a connection member with a connection engagement means mounted thereon, said connection engagement means operatively engaging said first engagement member of said frame structure means by moving along at least a portion of its contour; said second engagement member of said frame structure means used to keep said connection engagement means of said user engagement means in close proximity to said first engagement member of said frame structure means; whereby pivoting said user engagement means in the forward and backward directions produces upward and downward pivoting motion in said user support means.

18. The moving uplift apparatus as claimed in claim 17, said frame structure means further comprising:

a base;

at least one support member extending generally upward from said base, said first and second engagement members being curved members rotatably mounted to said support member, said engagement members being mounted to said support member in a generally horizontal alignment with one another.

19. The moving uplift apparatus as claimed in claim 18, said curved members being wheels.

20. The moving uplift apparatus as claimed in claim 18, said user support means further comprising:

at least one generally horizontal lever member, said lever member being pivotally mounted to said support member of said frame structure means;

at least one seat member mounted on one end of said lever member.

21. The moving uplift apparatus as claimed in claim 20, said user engagement means comprising:

at least two rocker members pivotally mounted to said lever member of said user support means, said rocker members being pivotally mounted on apposite ends of said lever members;

at least one upper engagement member mounted near the top of one of said rocker members;

said connection member pivotally connecting said rocker members so that said rocker members remain generally parallel to one another, said connection member operatively engaging said curved member of said frame structure means; whereby moving said connection member backward and forward against said curved member of said frame structure means produces upward and downward movement of said lever member of said user support means.

22. The moving uplift apparatus as claimed in claim 20, said user engagement means further comprising at least one lower engagement member mounted near the bottom of one of said rocker members.

23. The moving uplift apparatus as claimed in claim 20 further comprising a second generally horizontal lever member pivotally mounted on said support member of said frame structure means; said seat pivotally mounted to both lever members such that said lever member remain parallel to one another, and said seat maintains a generally horizontal position as said lever members pivot.

24. The moving uplift apparatus as claimed in claim 20 further comprising a rotatable member operatively connected to said lever member, said rotatable member making motion of said apparatus smoother.

25. The moving uplift apparatus as claimed in claim 24, said rotatable member being a flywheel.

26. The moving uplift apparatus as claimed in claim 24, said support member being turnable mounted to said base, said rotatable member being used to produce turning motion in said support member about said base.

27. The moving uplift apparatus as claimed in claim 24, said support member being turnably mounted to said base, said rotatable member being in rolling contact with said base for producing turning motion in said support member around said base.

28. The moving uplift apparatus as claimed in claim 17 further comprising a weight support assembly mounted on one end of said lever member.

29. The moving uplift apparatus as claimed in claim 17, said connection engagement means having a relatively flat side and rigidly mounted to said connection member such that said flat side engages said first engagement member at an angle, along its contour.

30. The moving uplift apparatus as claimed in claim 17, said connection engagement means being wheels rotatably mounted to said connection member, said wheels engaging said first engagement member along its contour.

* * * * *